US005169271A

United States Patent [19]

Yamashita

[11] Patent Number: 5,169,271

[45] Date of Patent: Dec. 8, 1992

[54] METHOD AND APPARATUS FOR CARRYING PACKAGES

[75] Inventor: Takashi Yamashita, Inuyama, Japan

[73] Assignee: Murata Kikai Kabushiki Kaisha, Kyoto, Japan

[21] Appl. No.: 734,970

[22] Filed: Jul. 24, 1991

[30] Foreign Application Priority Data

Jul. 31, 1990 [JP] Japan ..... 2-204364

[51] Int. Cl.[5] ..... B65G 57/28

[52] U.S. Cl. ..... 414/27; 414/790.2; 414/783; 414/908; 414/910; 414/911; 294/81.52

[58] Field of Search ..... 294/81.52, 67.2, 158; 414/27, 908, 910, 911, 789.9, 790.2, 795.4, 795.7, 783, 745.7, 745.8, 684, 331, 786; 242/67.1 R, 81, 82, 78, 79

[56] References Cited

U.S. PATENT DOCUMENTS

| | | | |
|---|---|---|---|
| 2,617,353 | 11/1952 | Ranney | 414/684 X |
| 2,687,226 | 8/1954 | Garrett | 414/908 X |
| 2,946,618 | 7/1960 | Klahn et al. | 294/81.52 |
| 3,424,488 | 1/1969 | Renfroe | 294/81.52 X |
| 3,559,371 | 2/1971 | Borrowman | 294/81.52 X |
| 3,926,382 | 12/1975 | Sieurin et al. | 242/81 X |
| 4,304,619 | 12/1981 | Riggs | 414/783 X |
| 4,509,891 | 4/1985 | Libscomb | 414/795.7 |
| 4,718,813 | 1/1988 | Kehlenbach | 414/911 X |
| 4,723,884 | 2/1988 | Brinker et al. | 414/908 X |
| 4,750,769 | 6/1988 | Tebb | 294/81.52 X |
| 4,830,568 | 5/1989 | Maccaferri | 414/911 X |
| 4,927,090 | 5/1990 | Matsumoto | 414/911 X |
| 4,975,018 | 12/1990 | Langenbacher et al. | 294/81.52 X |
| 4,992,016 | 2/1991 | Ferloni | 414/27 |

FOREIGN PATENT DOCUMENTS

| | | | |
|---|---|---|---|
| 542822 | 6/1957 | Canada | 414/684 |
| 2-100923 | 2/1990 | Japan . | |
| 144141 | 2/1962 | U.S.S.R. | 414/684 |
| 1403651 | 8/1975 | United Kingdom | 414/684 |

*Primary Examiner*—Michael S. Huppert
*Assistant Examiner*—Scott L. Lowe
*Attorney, Agent, or Firm*—Spensley Horn Jubas & Lubitz

[57] ABSTRACT

A method and apparatus for carrying a plurality of packages. A pivotable support rod having a tubular form defines a hollow inner diameter. The support rod receives packages from a doffing truck and supports the packages in a vertical orientation. A hanger is vertically lowered toward the support rod. The hanger includes package holding pawls located at the ends of longitudinal posts. A longitudinal guide member is centrally located among the posts and extends at least to the holding pawls. The guide member defines an outer diameter that is smaller than the hollow inner diameter of the support rod. The guide member is insertable into the hollow inner diameter of the support rod when the hanger is vertically lowered toward the support rod.

4 Claims, 5 Drawing Sheets

METHOD AND APPARATUS FOR CARRYING PACKAGES

FIELD OF THE INVENTION

The present invention relates to a method for transferring multiple stages of packages to a supporting rod from a doffing truck which receives the multiple stages of packages from a yarn take-up machine, then carrying the packages on a suspended hanger from an overhead carrier to a specific station.

RELATED ART STATEMENT

Automatic apparatus for receiving packages from a multitude of parallelly arranged spun yarn take-up machines are increasing due to the use of doffing truck equipped with a package receiving device and an empty take-up tube supply device. Multiple stages of packages which the doffing truck has received are carried to the home position of the doffing truck, where the multiple stages of packages are transferred at one time from the doffing truck to a peg stand having a horizontal supporting rod. This peg stand is carried on a carrier to the following process.

However, as this type of transport using a carrier running on the floor requires a space, it is desirable to use an overhead carrier. The overhead carrier can not carry a heavy load, and therefore it has been proposed such a method for carrying packages (Laid-Open Japanese Patent Application No. Hei 2-100923) in which a swingable supporting rod is raised upright after unloading multiple stages of packages from a doffing truck onto the supporting rod, and then a hanger vertically movably suspended from the overhead carrier is lowered to surround the supporting rod to receive only the multiple stages of packages by means of releasable clamping members provided at the lower ends of the hanger.

According to the above-described prior-art method for carrying packages using a hanger suspended from an overhead carrier, the hanger itself and its clamping member will inevitably come into direct contact with the yarn layer of the package. Particularly in the case of chemical synthetic fiber yarn packages, since the protection of the yarn layer is very important, it is preferable that the packages be carried by holding the package bobbins. This prior-art method of carrying packages using the hanger, therefore, has such a problem as insufficient protection of the yarn layer.

OBJECT AND SUMMARY OF THE INVENTION

In view of the above-described problem inherent in the heretofore known techniques, it is an object of the present invention to provide an improved method for carrying packages capable of carrying through bobbins while fully protecting the yarn layer of the packages.

For attaining the above-mentioned object, the present invention provides a method for package transport, in which a swingable supporting rod is raised upright after transferring multiple stages of packages from a doffing truck to the supporting rod, and a hanger vertically movably suspended from an overhead carrier is lowered to surround the supporting rod to receive the multiple stages of packages by means of releasable holding members provided at the lower ends of the hanger. Furthermore, an end plate is inserted over the supporting rod in advance so that the end plate will be held by means of the holding members.

Packages, being supported on bobbins by the end plate, can be carried through the bobbins without falling.

DETAILED DESCRIPTION OF PREFERRED EMBODIMENT

In the following, a preferred embodiment of the present invention will be explained with reference to the drawings.

Figure 2:
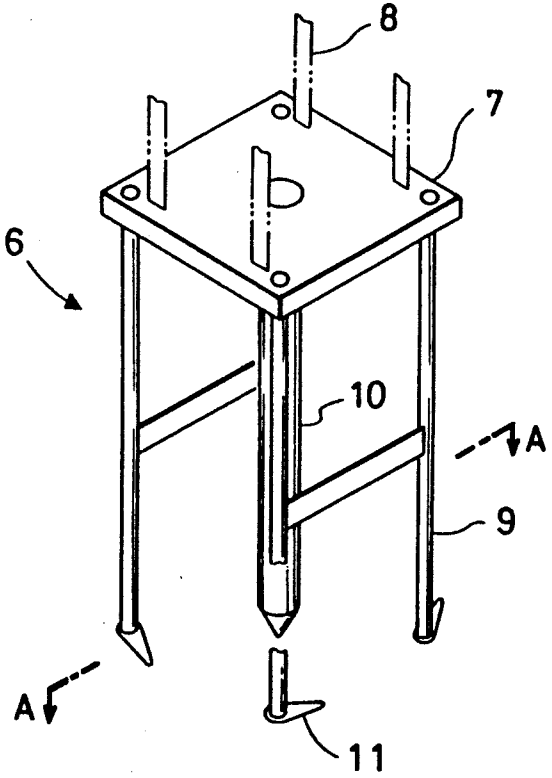
FIG. 2 is a perspective view of a hanger.
Figure 1:
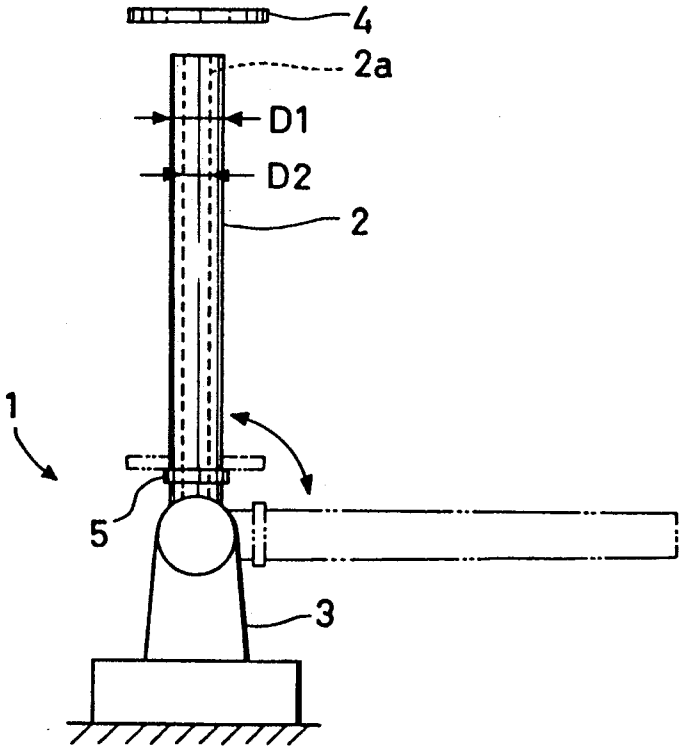
FIG. 1 is a view showing the construction of a supporting rod.

FIG. 1 is a view showing the construction of a supporting rod; and FIG. 2 is a perspective view of a hanger of an overhead carrier.

In FIG. 1 a numeral 1 refers to a package carrier with a supporting rod 2. The base end of the supporting rod 2 is swingably pivoted on a base 3, and a driving mechanism of known technique is provided to swing the supporting rod from the upright position indicated by a full line to the horizontal position indicated by an alternate long and two short dashes line and vice versa. The supporting rod 2 is of a cylindrical form, the outside diameter D1 of which is slightly smaller than the inside diameter of the bobbin. In the inside diameter D2 which is a guide hole 2*a* is larger enough to allow the insertion of a guide member which will be described in the following. On the outside diameter of the supporting rod 2 and end plate 4 can be inserted. The end plate 4 stops at a flange section 5 of the supporting rod 2. When packages are inserted on the supporting rod 2, the bobbin stops in contact with the end plate 4.

Figure 3:
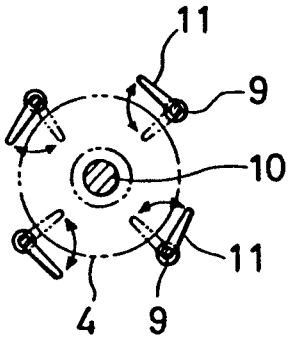
FIG. 3 is a sectional view taken along line A—A of FIG. 2.

In FIG. 2 a numeral 6 denotes a hanger suspended from the overhead carrier. The hanger consists of an overhead plate 7 suspended with a belt 8, four posts 9, and a central guide member 10. As shown in FIG. 3, holding pawls 11 which are holding members are rotatably installed on the lower end of each of the posts 9, being located in the releasing position indicated by a full line where the end plate 4 is released or in the holding position indicated by an alternate long and two short dash line. The guide member 10 is a rod having tapered extreme end, which extends to the level of the holding pawls.

Figure 4:
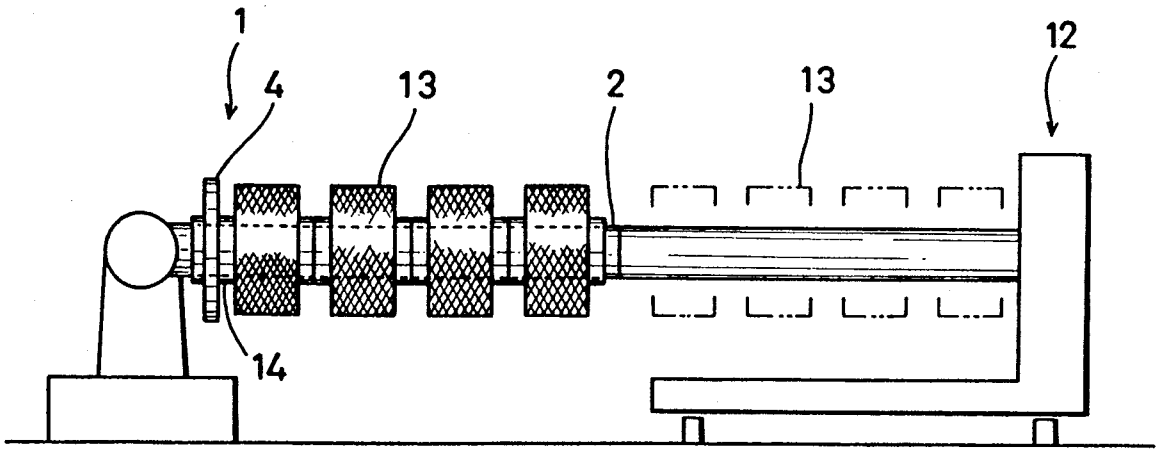
FIG. 4 is a view showing a method for carrying packages from a doffing truck to the supporting rod.

Next, a method of carrying the packages from the doffing truck to the supporting rod will be explained with reference to FIG. 4. On the supporting rod 2 is inserted the end plate 4 in advance in the illustrated horizontal position. The doffing truck travels as far as an opposite position of the supporting rod 2 and stops. Packages 13 are transferred to the supporting rod 2 by means of a pusher on the doffing truck 12 side. In this case, a bobbin 14 of the package 13 is in contact with the end plate 4.

Figure 5A:
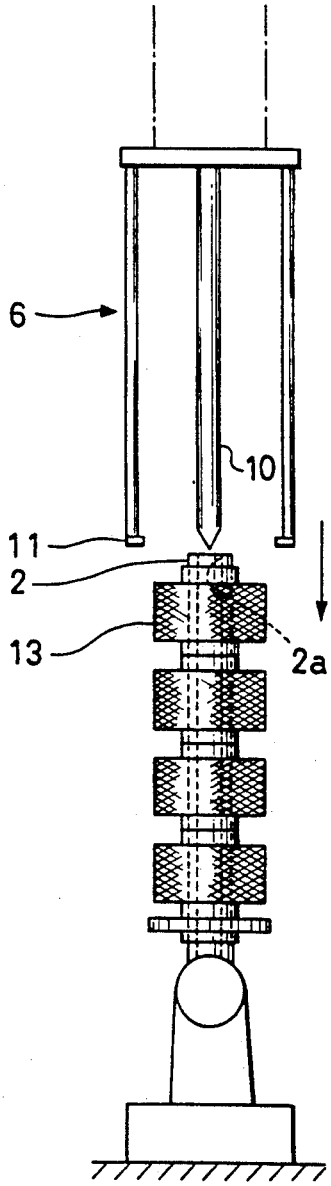
FIGS. 5*a*–5*c* are views showing a method for carrying the packages from the supporting rod to the hanger.
Figure 5B:
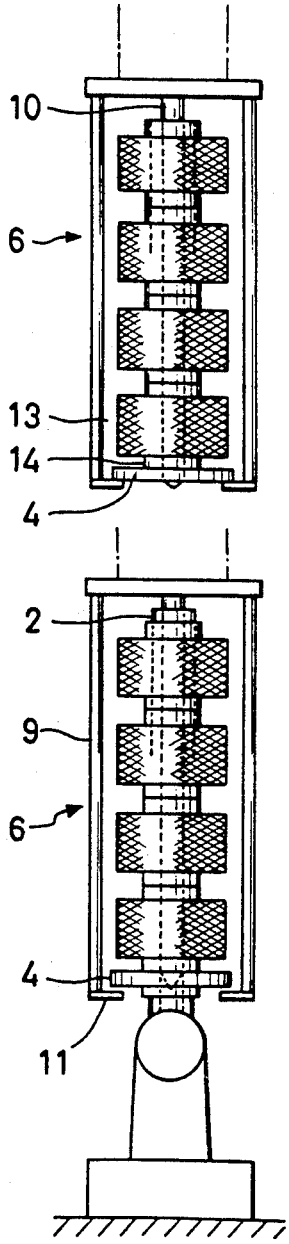
Figure 5C:
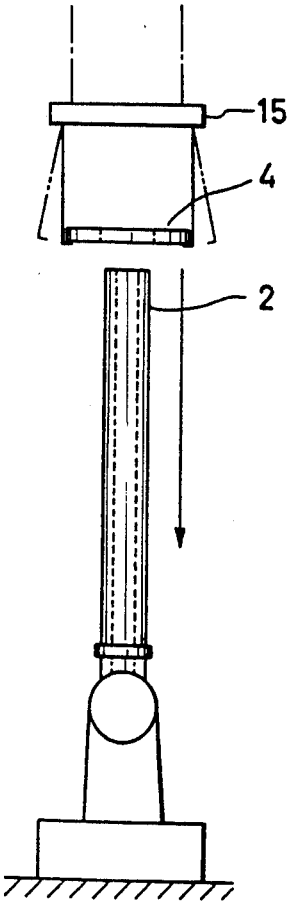

Next, a method of carrying the packages from the supporting rod to the hanger will be explained with reference to FIG. 5. As shown in FIG. 5*a*, the supporting rod 2 is in the upright position, and right above the supporting rod 2 the hanger 6 comes to stop and lowers. First, the lower end of the guide member 10 of the hanger 6 goes into the guide hole 2*a* of the supporting rod 2. With the insertion of the guide member 10 into the guide hole 2*a* of the guide member 10, the position of the hanger 6 is determined, thus maintaining a specific clearance between the package 13 and the holding pawl 11. Then, as shown at the bottom of FIG. 5*b*, the hanger 6 surrounds the supporting rod 2, the holding pawls 11 coming below the level of the end plate 4. In this state, the hanger 6 stops and the holding pawls 11 rotate in the holding position illustrated. When the hanger 6 moves upwardly, as shown at the top of FIG. 5*b*, the bobbins 14 of the packages 13 come in contact with the end plate 4; that is, the bobbins of multiple stages of packages 13 are inserted by the guide member 10. As shown in FIG. 5*c*, an elevating frame 15 of another overhead carrier carries the end plate 4, going into the supporting rod 2. Repeating the above-described operation a package carrier 1 carries packages in succession from the doffing truck.

The transport of the packages with the guide member 10 inserted in the bobbins 14 is performed by using the end plate 4 and an engaging mechanism consisting of the guide hole 2*a* of the supporting rod 2 and the guide member 10 of the hanger 6 which were explained with reference to FIGS. 4 and 5. In this case, as shown at the bottom of FIG. 5*b*, it is possible to prevent the interference of the posts 9 and the holding pawls 11 of the hanger 6 with the packages 13. Further, as shown at the top of FIG. 5*b*, since the guide member 10 is inserted in the bobbins 14 of the packages 13, the packages 13 can be prevented from falling or sliding.

Figure 7:
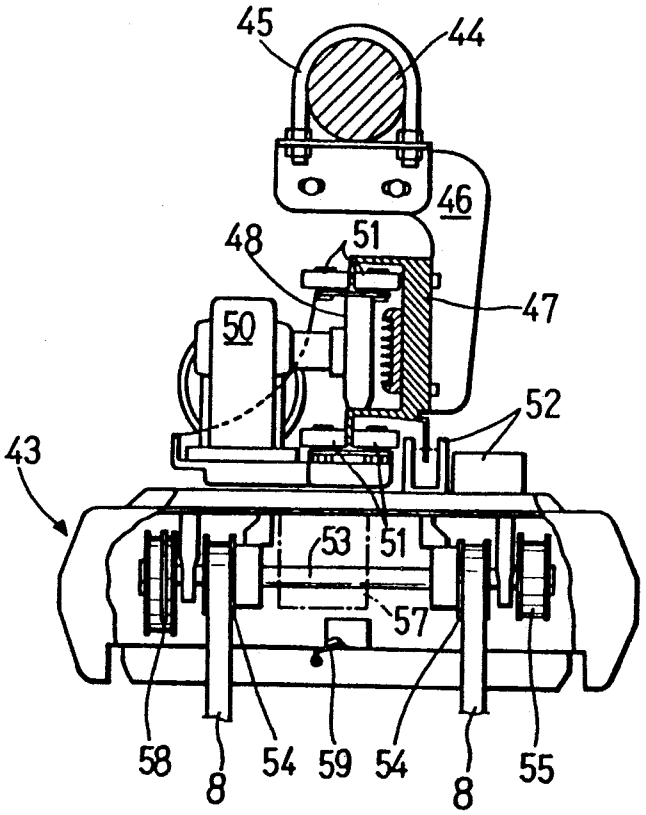
FIG. 7 is a front view of the overhead carrier.
Figure 6:
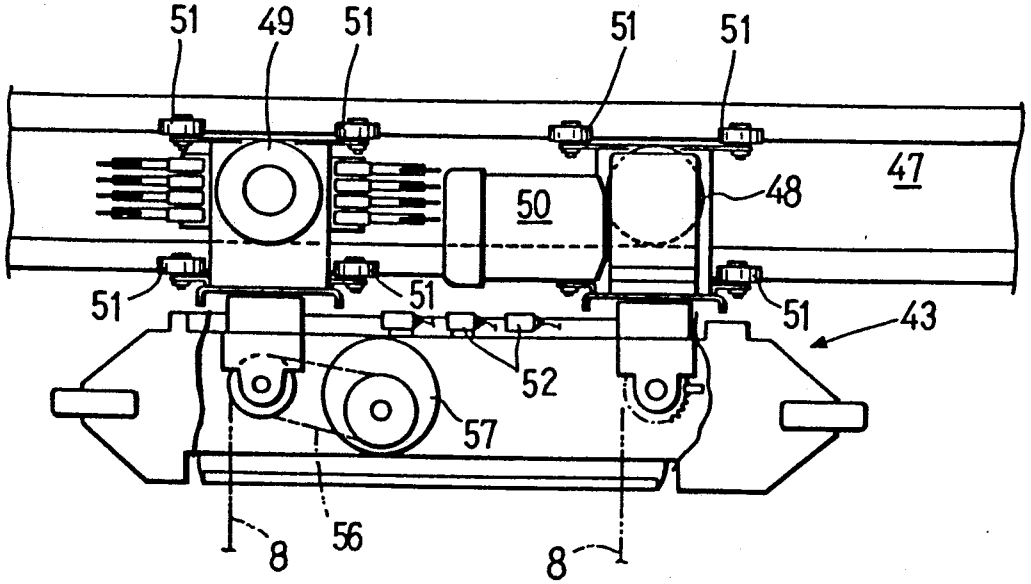
FIG. 6 is a side view of an overhead carrier.

Next, the construction of the overhead carrier traveling with a vertically movable hanger suspended therefrom will be explained. FIG. 6 is a side view of the overhead carrier, and FIG. 7 is a front view of the overhead carrier. In FIGS. 6 and 7, the overhead carrier 43 has a drive wheel 48 and a driven wheel 49 both running on a rail 47 laid on a hoisting accessory 46 installed by U-bolts 45 to an overhead beam 44, and also has a running motor 50 for driving the drive wheel 48. In the upper part of the overhead carrier 43 are provided a plurality of guide rollers 51 which are engaged at appropriate positions with the rail 47 for preventing the lateral sway of the overhead carrier on the rail 47. Further, in appropriate points of the overhead carrier 43 are installed as many sensors 52 as needed for sensing stop and passing of the overhead carrier 43.

The mechanism that the hanger is vertically movably suspended from the overhead carrier 43 is as follows. The overhead carrier 43 has a pair of horizontal shafts 53 for winding and unwinding a plurality of belts 8 for suspending the hanger. These horizontal shafts 53 carry drums 54 on both ends for direct winding of the belts 8. The horizontal shafts 53 are connected with each other through a timing belt 55 so as to rotate simultaneously. One of the horizontal shafts 53 is driven by power from a hoisting motor 57 through a belt 56, turning to wind and unwind the belt 8. The other horizontal shaft 53 is equipped, on the end section, with an encoder 58 for measuring the amount of winding and unwinding of the belt 8. Also there is provided, at an appropriate place, a limit switch 59 for detecting the position of the top end of stroke of the hanger. The above-described overhead carrier 43 travels between an incoming station and an outgoing station where the package carrier is set.

Figure 8:
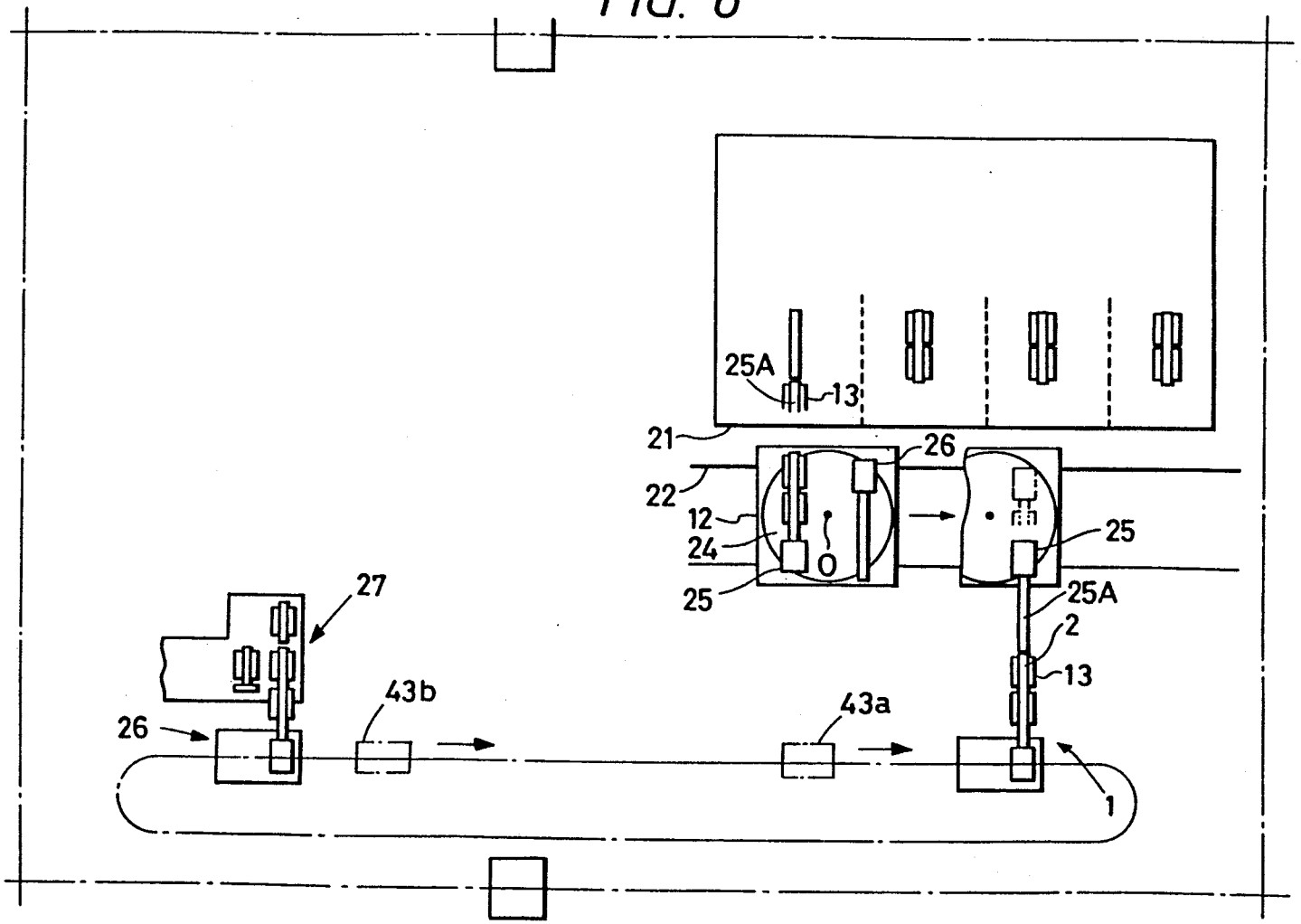
FIG. 8 is a view showing a processing system using the package carrying method according to the present invention.

Next, an example of applied layout of the above-described method for carrying the packages will be explained. In FIG. 8, the doffing truck 12 is movably mounted on the rail 22 laid along the row of spun yarn take-up machines 21. On a turntable 24 of the doffing truck 12 which can turn through 180 degrees each time, a package receiving device 25 and a take-up tube supply device 26 are mounted. These devices are arranged in point-symmetrical positions in relation to the center 0 of rotation. Therefore, after a supporting shaft 25A of the package receiving device 25 advances to receive the packages 13, the turntable 24 rotates through 180 degrees, where the supporting shaft 25A of the package receiving device 25 comes on the package carrier 1 side. Then the doffing truck 12 travels to the front of the package carrier 1 to move the supporting shaft 25A forward. In this position, the supporting shaft 25A is in contact with the supporting rod 2 of the package carrier 1. Thus a plurality of the packages 13 (only two packages are illustrated) are transferred at a time to the supporting rod 2 by means of a transferring means such as a pusher on the package receiving device 25 side. Subsequently the package carrier 1 operates to raise the supporting rod 2 upright, and packages are transferred to the hanger by an overhead carrier 43*a*. Then, an end plate being carried by another overhead carrier 43*b* is inserted over the supporting shaft 2. The overhead carrier 43*a* travels as far as the take-up tube supply device 26, and unloads the packages. At this take-up tube supply device 26, the packages are separated by means of a package distributing device 27. The end plate of the take-up tube supply device 26 is then removed from the supporting shaft 2, being carried by the overhead carrier 43*b*. As has been heretofore described, fully automatic package transport in a spun yarn take-up machine can be realized.

In the foregoing, package transport in the spun yarn take-up machine using a doffing truck has been described. It is also possible, however, to apply the method according to the present invention to an apparatus for receiving packages one by one onto the supporting rod inclined to an oblique position from a doubler.

The method for carrying packages according to the present invention, since an end plate is inserted on a supporting rod in advance, and a guide member disposed at the center of the hanger is inserted in a guide hole provided at the center of the supporting rod in order to hold the end plate with the aforementioned holding members, packages can be held by the end plate at the bobbin and carried through the bobbin without falling or sliding, thereby fully protecting the yarn layer of the packages.

What is claimed is:

1. An apparatus for carrying a plurality of packages, comprising:

a pivotable support rod for receiving a plurality of packages from a doffing truck and for supporting the plurality of packages in a substantially vertical orientation, the support rod having a substantially tubular form having a hollow inner diameter, a hanger that is vertically lowerable toward the support rod, the hanger comprising:

a plurality of substantially longitudinal posts, at least one of the plurality of posts having a lower end, releasable engagement means for supporting at least one of the plurality of packages, the releasable engagement means being associated with the lower end of the post, a substantially longitudinal guide member positioned substantially equidistant from each of the plurality of posts and extending at least to the releasable engagement means, the guide member having an outer diameter that is smaller than the hollow inner diameter of the support rod, and an end plate insertable on the support rod and configured for abutting contact with at least one of the plurality of packages, whereby the guide member is insertable into the hollow inner diameter of the support rod when the hanger is vertically lowered toward the support rod.

2. The apparatus as defined in claim 1, wherein the support rod defines a lower portion having a flange against which the end plate abuts.

3. An apparatus for carrying a plurality of packages, comprising:

a pivotable support rod for receiving a plurality of packages from a doffing truck and for supporting the plurality of packages in a substantially vertical orientation, the support rod having a substantially tubular form having a hollow inner diameter, a hanger that is vertically lowerable toward the support rod, the hanger comprising:

a plurality of substantially longitudinal posts, at least one of the plurality of posts having a lower end, releasable engagement means for supporting at least one of the plurality of packages, the releasable engagement means being associated with the lower end of the post, a substantially longitudinal guide member positioned substantially equidistant from each of the plurality of posts and extending at least to the releasable engagement means, the guide member having an outer diameter that is smaller than the hollow inner diameter of the support rod, wherein at least one of the plurality of packages comprises a take-up tube having an inner diameter, wherein the support rod defines an outer diameter, and wherein the outer diameter defined by the support rod is smaller than the inner diameter defined by the take-up tube, whereby the guide member is insertable into the hollow inner diameter of the support rod when the hanger is vertically lowered toward the support rod.

4. A method of carrying a plurality of packages, comprising:

transferring the plurality of packages onto a pivotable support rod having a substantially tubular form having a hollow inner diameter, orienting the support rod in a substantially vertical orientation, providing a hanger substantially above the support rod, the hanger comprising a plurality of substantially longitudinal posts, at least one of the plurality of posts having a lower end, releasable engagement means for supporting at least one of the plurality of packages, the releasable engagement means being associated with the lower end of the post, and a substantially longitudinal guide member positioned substantially equidistant from each of the plurality of posts and extending at least to the releasable engagement means, the guide member having an outer diameter that is smaller than the hollow inner diameter of the support rod, lowering the hanger toward the support rod, inserting the substantially longitudinal guide member into the hollow inner diameter of the support rod as the hanger is vertically lowered toward the support rod, releasing the engagement means to support at least one of the plurality of packages, and inserting an end plate on the support rod prior to transferring the plurality of packages onto the support rod, and wherein the step of releasing the engagement means to support at least one of the plurality of packages comprises releasing the engagement means to engage the end plate.

* * * * *